US005417762A

United States Patent [19]

Sieberth

[11] Patent Number: 5,417,762

[45] Date of Patent: May 23, 1995

[54] MOUNTING APPARATUS FOR DOCTOR BLADES

[75] Inventor: Ralf Sieberth, Appleton, Wis.

[73] Assignee: Voith Sulzer Papiermaschinen GmbH, Heidenheim, Germany

[21] Appl. No.: 926,825

[22] Filed: Aug. 7, 1992

[30] Foreign Application Priority Data

Aug. 7, 1991 [DE] Germany ..... 9109787 U

[51] Int. Cl.[6] ..... B05C 1/04

[52] U.S. Cl. ..... 118/126; 118/413; 100/174; 162/281; 101/162; 101/425

[58] Field of Search ..... 118/126, 413; 15/256.51; 100/174; 162/281; 101/162, 425; 427/356

[56] References Cited

U.S. PATENT DOCUMENTS

| | | | |
|---|---|---|---|
| 3,301,214 | 1/1967 | Coghill | 118/126 |
| 3,358,643 | 12/1967 | Faeber | 118/126 |
| 3,688,336 | 9/1972 | Costello, Jr. et al. | 118/126 |
| 3,859,690 | 1/1975 | Brown | 15/256.51 |
| 4,169,425 | 10/1979 | Wohrle | 118/126 |
| 4,651,672 | 3/1987 | Sommer | 118/126 |
| 4,859,507 | 8/1989 | Damrau | 118/126 |
| 4,899,687 | 2/1990 | Sommer et al. | 118/126 |
| 5,081,951 | 1/1992 | Most et al. | 118/126 |

*Primary Examiner*—W. Gary Jones
*Assistant Examiner*—John Hoffmann
*Attorney, Agent, or Firm*—Baker & Daniels

[57] ABSTRACT

A blade mounting apparatus for a blade in a coater secures essentially the entire blade length. The coater provides a cross profile adjustment of a suspension flow. The blade mounting apparatus includes an adjustable thrust element engaging the blade along a line-shaped thrust contact area extending in a direction parallel to the longitudinal edge of the blade. The position of the contact area of the adjustable thrust element is variably adjustable, with local limitation, for providing cross profile adjustment.

6 Claims, 2 Drawing Sheets

MOUNTING APPARATUS FOR DOCTOR BLADES

BACKGROUND OF THE INVENTION

1. Field of the Invention

The present invention relates to a mounting apparatus for a doctor blade, and, more particularly, to doctor blades having adjustable localized contact pressure.

2. Description of the Related Art

Blade mounting apparatus for coating systems for paper or cardboard are known, e.g., from U.S. Pat. No. 3,301,214. The blade is fixed on one side (which extends parallel to its longitudinal edge) to mount the blade. Force is applied to the opposing side of the blade by means of thrust parts disposed along a line parallel to it on the material web, or on the backing roll carrying it, to bend the blade in the process, thus generating a localized contact pressure. The blade is pressed down by means of slat-shaped thrust parts and adjustment screws, making it possible to generate a locally varying contact force so as to achieve a uniform cross profile of the coating application (i.e., that practically no cross profile is visible). Conventional blade mounting apparatus induce two types of dimensional error, i.e., error associated with the blade mounting, and error associated with the point of pressure.

What is needed in the art is a blade mounting apparatus which reduces dimensional error associated with the blade mounting and/or the point of pressure.

SUMMARY OF THE INVENTION

The present invention provides a blade mounting apparatus for doctor blades, specifically in coaters with a cross profile adjustment system, where the blade mounting apparatus retains the blade essentially across its entire length. The blade mounting apparatus is formed with an essentially line-shaped thrust point along a line parallel to the longitudinal edges of the blade, and the position of the thrust point on the blade is variable with local limitation, for purposes of cross profile adjustment of the suspension flow.

In this case, a simple support of the blade is effected on its longitudinal edge opposite its working edge while the blade mounting and cross profile adjustment is effected essentially at the same, essentially line-shaped point which generally extends parallel to the rear edge.

The invention comprises, in one form thereof, a blade mounting apparatus for a blade in a coater. The coater provides a cross profile adjustment of a suspension flow. The blade mounting apparatus secures essentially the entire blade length and includes an adjustable thrust element engaging the blade along a line-shaped thrust contact area extending in a direction parallel to the longitudinal edge of the blade. The position of the contact area of the thrust element is variably adjustable for providing cross profile adjustment.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
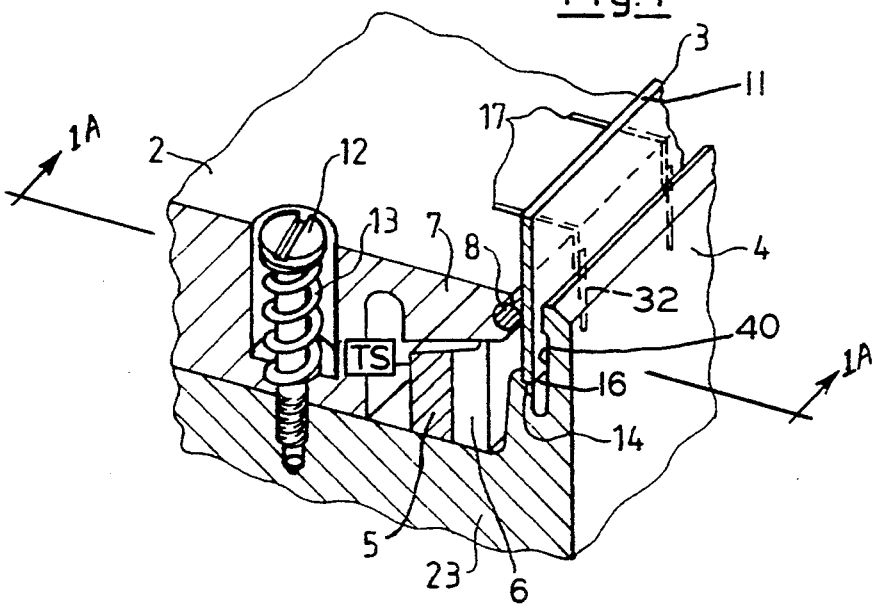
FIG. 1 is a perspective, partially sectional view of one embodiment of the present invention.
Figure 2:
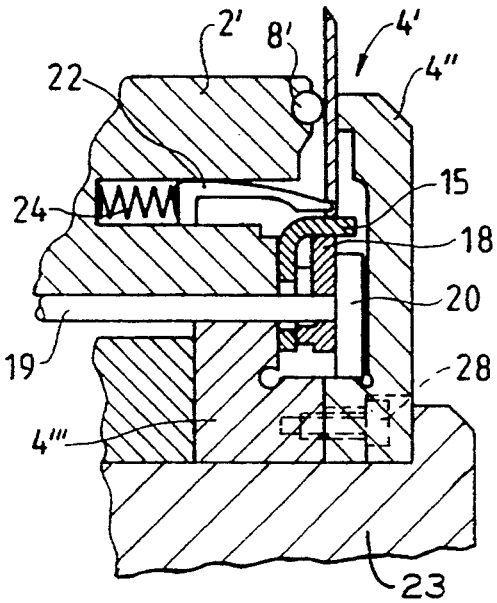
FIG. 2 is a sectional view of an alternative embodiment.

Referring now to the drawings and particularly to FIG. 1, there is shown a blade mounting apparatus 10 of the present invention. Blade mounting apparatus 10 includes a clamping plate 2 which engages blade 3 with an adjustable thrust element. In the embodiment shown in FIGS. 1 and 2, the adjustable thrust element is small bearings 8 that push against blade 3. Blade 3 is fixed against a backing part 4 of a mounting plate 23 which is installed on the blade support beam 1 (FIG. 2). Backing part 4 has a clamping member or support edge 14 for supporting the rear edge 16 of blade 3. Support edge 14 extends in a direction which is parallel to the working edge 11 of blade 3. Enabling an easy movability of the blade, the bearing 8 is held in an elastic bearing mount 7 formed on the clamping plate 2 by slots 17 extending through it transverse to the bearing 8. The bearing mounts 7 are connected to the clamping plate 2 at a flexible juncture. The clamping plate 2, in turn, is retained on the mounting plate 23 by compression springs 13 fashioned as cylindrical helical springs. This enables an adjustment of the basic load. The adjustment of the bearing mounts 7 takes place in the direction of the width (height) of blade 3, by means of a wedge-shaped thrust slat 5 extending parallel to blade 3. Thrust slat 5 includes slots 6 similar to the slots 17 of bearing mounts 7. Thrust slat 5 is locally adjustable, e.g., by traction-thrust screws threadingly engaging thrust slat 5 and extending generally perpendicular to blade 3. Other adjustment mechanisms may be provided for this adjustment, e.g., piezo translators or thermal metal bars. Slots 17 are not absolutely necessary.

Bearing 8 is locally adjusted in the direction of the blade width by shifting the thrust slat 5, so that the clamping length of blade 3 changes between its support edge 14 and the bearing 8. Of course, this changes also the exposed length of blade 3 between the bearing 8 and its working edge 11, thereby varying the flexure of the blade due to the thrust force. Blade 3, naturally, may bear, or may be forced down, also between its bearing 8 and the working edge 11, on a support slat provided with an essentially straight-line support edge.

Illustrated in FIG. 2 is an arrangement having a support element 15 with a movable support edge for the rear edge of the blade. Functionally similar parts are referenced here the same as in FIG. 1, but with the use of prime signs. The adjustment of this support element is effected by means of an eccentric member 18, which may be a round plate supported by a shaft 19 and bearing on a support plate 20. Both plates 18 and 20 are fastened to the shaft 19. A local adjustment of the individual support elements 15 changes here also the clamping length of the blade, the same as in the case of FIG. 1. The blade is fixed here additionally by a leaf type spring 22 which by way of one or several cylindrical helical springs 24 is forced on blade 3 at contact area 25. Blade 3 is thereby forced firmly on the support element 15. On the bearing line of the spring 22, the blade may also be formed with a shoulder 26 which assists in forcing blade 3 on the support element 15. Backing part 4' consists of two parts 4'' and 4''' joined by means of screws 28.

Figure 3:
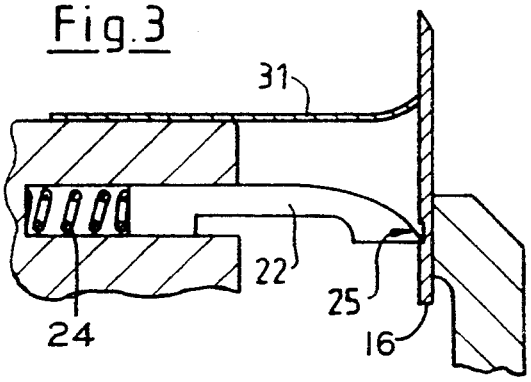
FIG. 3 is a sectional view of another embodiment of the invention.
Figure 1A:
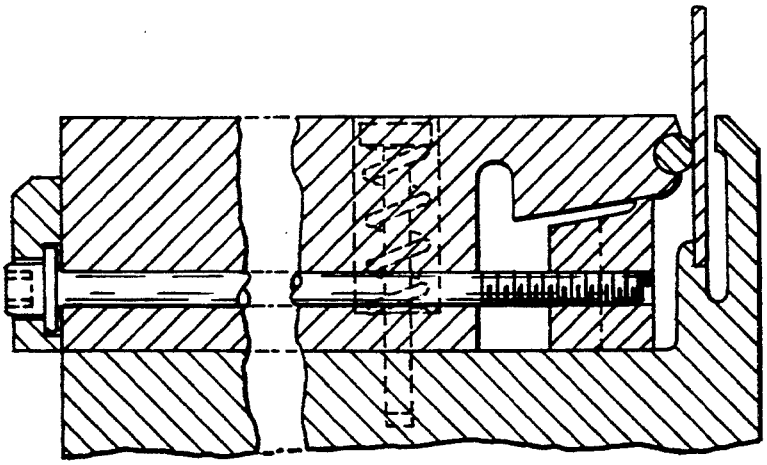
FIG. 1A is a sectional view taken along 1A–1A of FIG. 1.

In the case of FIG. 3, leaf type spring 22 has a double function, namely to both force the blade on its support edge and to fix the blade as such in the blade mounting; that is, leaf type spring 22 also assumes the function of bearings 8 and 8' of FIG. 1 or 2. Illustrated here, additionally, is a protective foil 31 which protects the blade mounting apparatus from splashing coating mixture or cleaning fluid. Foil 31 can be used also with arrangements according to the other figures.

For better sliding of the blade on the backing part 4'' according to FIG. 2, the bearing edge for the blade may be teflon-coated. The same is true, naturally, also for the arrangement according to FIG. 3.

The slots 17, respectively the adjustment mechanism 18 through 20 (FIG. 2), characterize the individual adjustment areas for the cross profile control.

These areas have a length (measured parallel to the blade) of about 100 to 180 mm. To increase the flexibility of the blade in the direction of its width, for the cross profile of the coating application, the blade may preferably be slotted in this direction, preferably for the embodiments according to FIG. 2 or 3. The mutual spacing of the slots may have dimensions, on the average, between 40 and 80 mm; and may also possibly vary, i.e., repetitive from adjustment range to adjustment range, or approximately equal to the individual adjustment range.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A blade mounting apparatus for a blade in a coater, the coater providing a cross profile adjustment of a suspension flow, the blade including a longitudinal working edge, an opposite rear edge and a width extending from said working edge to said rear edge, said blade mounting apparatus securing the blade essentially along the entire blade length, said blade mounting apparatus comprising an adjustable thrust element, said adjustable thrust element engaging the blade along a line-shaped thrust contact area extending in a direction parallel to the longitudinal edge of the blade, the position of said line-shaped thrust contact area of said adjustable thrust element being variably adjustable in a direction corresponding to a width of the blade and locally adjustable at a plurality of spaced locations along the length of the blade, for providing cross profile adjustment.

2. The blade mounting apparatus of claim 1, wherein said adjustable thrust element comprising a bearing, said bearing defining said line shaped thrust contact area; and an elastic bearing mount carrying said bearing; and further comprising a support edge for supporting the rear edge of the blade, said support edge extending parallel to the length of the blade.

3. The blade mounting apparatus of claim 2, further comprising an adjustment mechanism for said bearing comprising a wedge-shaped thrust slat, said thrust slat extending generally parallel to said blade working edge, said thrust slat engaging said elastic bearing mount to variably adjust said bearing in the direction corresponding to the width of the blade.

4. The blade mounting apparatus of claim 1, further comprising a clamping member defining a clamping area, said adjustable thrust element comprising a bearing defining said line-shaped thrust contact area, said clamping member extending parallel to the blade working edge.

5. The blade mounting apparatus of claim 1, further comprising at least one leaf spring, said leaf spring extending generally transverse to the blade, said leaf spring bent toward said rear edge of the blade and exerting a force on the blade in a direction toward said blade rear edge.

6. The blade mounting apparatus of claim 5, wherein only said leaf spring fixedly secures the blade in a blade mounting.

* * * * *